US007886991B2

(12) United States Patent
Zuo et al.

(10) Patent No.: US 7,886,991 B2
(45) Date of Patent: Feb. 15, 2011

(54) PREMIXED DIRECT INJECTION NOZZLE

(75) Inventors: Baifang Zuo, Simpsonville, SC (US); Thomas Edward Johnson, Greer, SC (US); Benjamin Paul Lacy, Greer, SC (US); Willy Steve Ziminsky, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 222 days.

(21) Appl. No.: 12/245,266

(22) Filed: Oct. 3, 2008

(65) Prior Publication Data

US 2010/0084490 A1 Apr. 8, 2010

(51) Int. Cl.
*B05B 1/24* (2006.01)

(52) U.S. Cl. ..... 239/13; 239/125; 239/132; 239/132.5; 239/403; 239/406; 239/424.5; 60/737; 60/742; 60/772

(58) Field of Classification Search ..... 239/13, 239/125, 128, 132–132.5, 403–406, 424, 239/424.5; 60/737, 740, 742, 748, 772
See application file for complete search history.

(56) References Cited

U.S. PATENT DOCUMENTS

| | | | | |
|---|---|---|---|---|
| 6,019,596 | A * | 2/2000 | Knopfel et al. | 60/737 |
| 6,453,673 | B1 * | 9/2002 | Bechtel et al. | 60/776 |
| 7,412,833 | B2 * | 8/2008 | Widener | 239/132.5 |
| 2008/0078160 | A1 | 4/2008 | Kraemer et al. | |

* cited by examiner

*Primary Examiner*—Steven J Ganey
(74) *Attorney, Agent, or Firm*—Cantor Colburn LLP

(57) ABSTRACT

An injection nozzle having a main body portion with an outer peripheral wall is disclosed. The nozzle includes a plurality of fuel/air mixing tubes disposed within the main body portion and a fuel flow passage fluidly connected to the plurality of fuel/air mixing tubes. Fuel and air are partially premixed inside the plurality of the tubes. A second body portion, having an outer peripheral wall extending between a first end and an opposite second end, is connected to the main body portion. The partially premixed fuel and air mixture from the first body portion gets further mixed inside the second body portion. The second body portion converges from the first end toward said second end. The second body portion also includes cooling passages that extend along all the walls around the second body to provide thermal damage resistance for occasional flame flash back into the second body.

20 Claims, 3 Drawing Sheets

PREMIXED DIRECT INJECTION NOZZLE

FEDERAL RESEARCH STATEMENT

This invention was made with Government support under Contract No. DE-FC26-05NT42643, awarded by the Department of Energy. The Government has certain rights in the invention.

BACKGROUND OF THE INVENTION

The subject matter disclosed herein relates to premixed direct injection nozzles and more particularly to a direct injection nozzle having better mixing that includes a cooling system to provide resistance to thermal damage.

The primary air polluting emissions usually produced by gas turbines burning conventional hydrocarbon fuels are oxides of nitrogen, carbon monoxide, and unburned hydrocarbons. It is well known in the art that oxidation of molecular nitrogen in air breathing engines is highly dependent upon the maximum hot gas temperature in the combustion system reaction zone. One method of controlling the temperature of the reaction zone of a heat engine combustor below the level at which thermal NOx is formed is to premix fuel and air to a lean mixture prior to combustion There are several problems associated with dry low emissions combustors operating with lean premixing of fuel and air. That is, flammable mixtures of fuel and air exist within the premixing section of the combustor, which is external to the reaction zone of the combustor. Typically, there is some bulk burner tube velocity, above which a flame in the premixer will be pushed out to a primary burning zone. There is a tendency for combustion to occur within the premixing section due to flashback, which occurs when flame propagates from the combustor reaction zone into the premixing section, or auto ignition, which occurs when the dwell time and temperature for the fuel/air mixture in the premixing section are sufficient for combustion to be initiated without an igniter. The consequences of combustion in the premixing section, and the resultant burn in the nozzle, are degradation of emissions performance and/or overheating and damage to the premixing section.

With natural gas as the fuel, premixers with adequate flame holding margin may usually be designed with reasonably low air-side pressure drop. However, with more reactive fuels, such as high hydrogen fuel, designing for flame holding margin and target pressure drop becomes a challenge. Since the design point of state-of-the-art nozzles is about 3000 degrees Fahrenheit flame temperature, flashback into the nozzle can cause damage to the nozzle in a very short period of time.

BRIEF DESCRIPTION OF THE INVENTION

According to one aspect of the invention, an injection nozzle having a main body portion with an outer peripheral wall is provided. The nozzle includes a plurality of fuel injection tubes disposed within the main body portion and a fuel flow passage fluidly connected to the plurality of fuel injection tubes. A second body portion, having an outer peripheral wall extending between a first end and an opposite second end, is connected to the main body portion. The second body portion converges from the first end toward said second end and also includes a cooling passage that extends at least partially along the outer peripheral wall.

According to another aspect of the invention, a method of cooling an injection nozzle is provided, comprising guiding a first fluid into a plurality of injection tubes disposed within a main body portion of the nozzle and flowing a second fluid into the plurality of injection tubes. First and second fluids are mixed in the plurality of injection tubes and are accelerated the first and second into a second body portion of the nozzle having a second mixing zone. The first and second fluids are expelled beyond an outer wall of said second body portion to a burn zone, while coolant is passing along at least a portion of the outer wall of the second body portion.

According to yet another aspect of the invention, a method of cooling an injection nozzle is provided, comprising guiding a first fluid into a plurality of injection tubes disposed within a main body portion of the nozzle and flowing a second fluid into said plurality of injection tubes. Mixing the first and second fluids in the plurality of injection tubes and accelerating the first and second mixed fluids into a second body portion of said nozzle comprising a second mixing zone. Delivering the first and second fluids beyond an outer wall of said second body portion to a burn zone while impinging a coolant along at least a portion of a surface opposite an inner surface of said second body portion and expelling a coolant into the second mixing zone to create a film cooling zone along at least a portion of said inner surface of the second body portion.

These and other advantages and features will become more apparent from the following description taken in conjunction with the drawings.

BRIEF DESCRIPTION OF THE DRAWING

The subject matter which is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
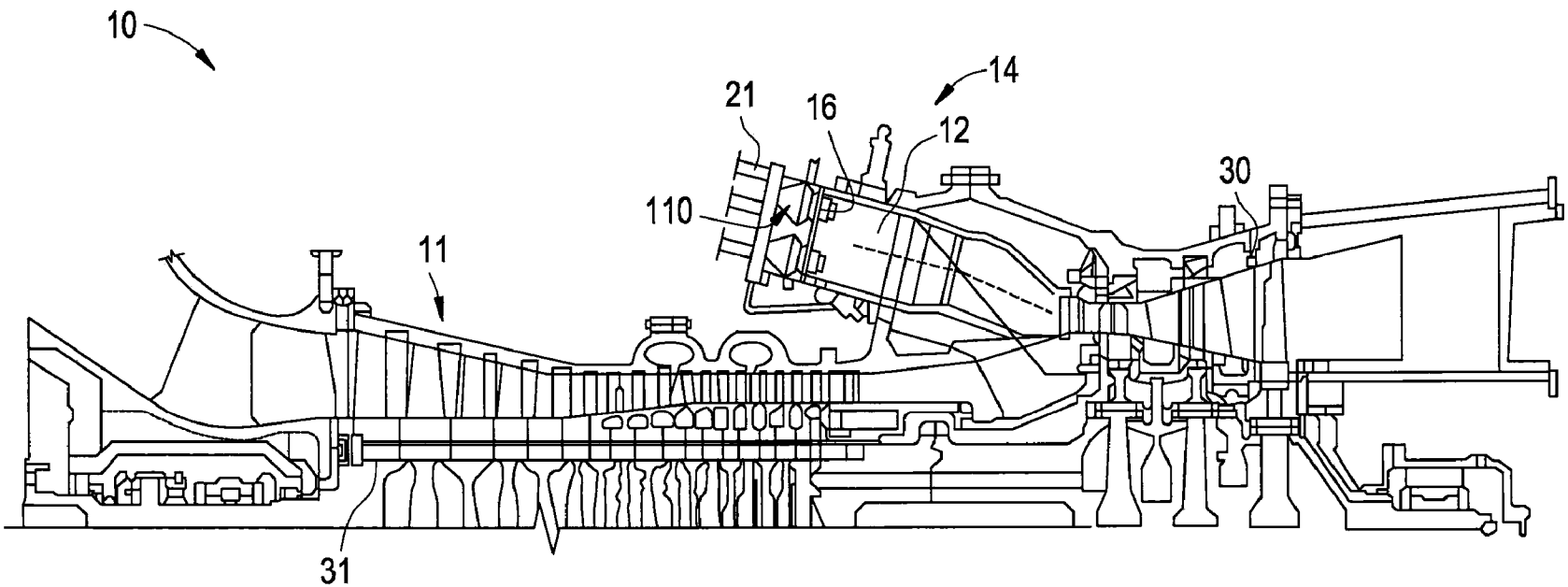
FIG. 1 is a cross-section of a gas turbine engine, including the location of injection nozzles in accordance with the present invention.

Referring now to FIG. 1 where the invention will be described with reference to specific embodiments, without limiting same, a schematic illustration of an exemplary gas turbine engine 10 is shown. Engine 10 includes a compressor 11 and a combustor assembly 14. Combustor assembly 14 includes a combustor assembly wall 16 that at least partially defines a combustion chamber 12. A pre-mixing apparatus or nozzle 110 extends through combustor assembly wall 16 and leads into combustion chamber 12. As will be discussed more fully below, nozzle 110 receives a first fluid or fuel through a fuel inlet 21 and a second fluid or compressed air from compressor 11. The fuel and compressed air are mixed, passed into combustion chamber 12 and ignited to form a high temperature, high pressure combustion product or gas stream. Although only a single combustor assembly 14 is shown in the exemplary embodiment, engine 10 may include a plurality of combustor assemblies 14. In any event, engine 10 also includes a turbine 30 and a compressor/turbine shaft 31

(sometimes referred to as a rotor). In a manner known in the art, turbine 30 is coupled to, and drives shaft 31 that, in turn, drives compressor 11.

In operation, air flows into compressor 11 and is compressed into a high pressure gas. The high pressure gas is supplied to combustor assembly 14 and mixed with fuel, for example process gas and/or synthetic gas (syngas), in nozzle 110. The fuel/air or combustible mixture is passed into combustion chamber 12 and ignited to form a high pressure, high temperature combustion gas stream. Alternatively, combustor assembly 14 can combust fuels that include, but are not limited to natural gas and/or fuel oil. In any event, combustor assembly 14 channels the combustion gas stream to turbine 30 which coverts thermal energy to mechanical, rotational energy.

Figure 2:
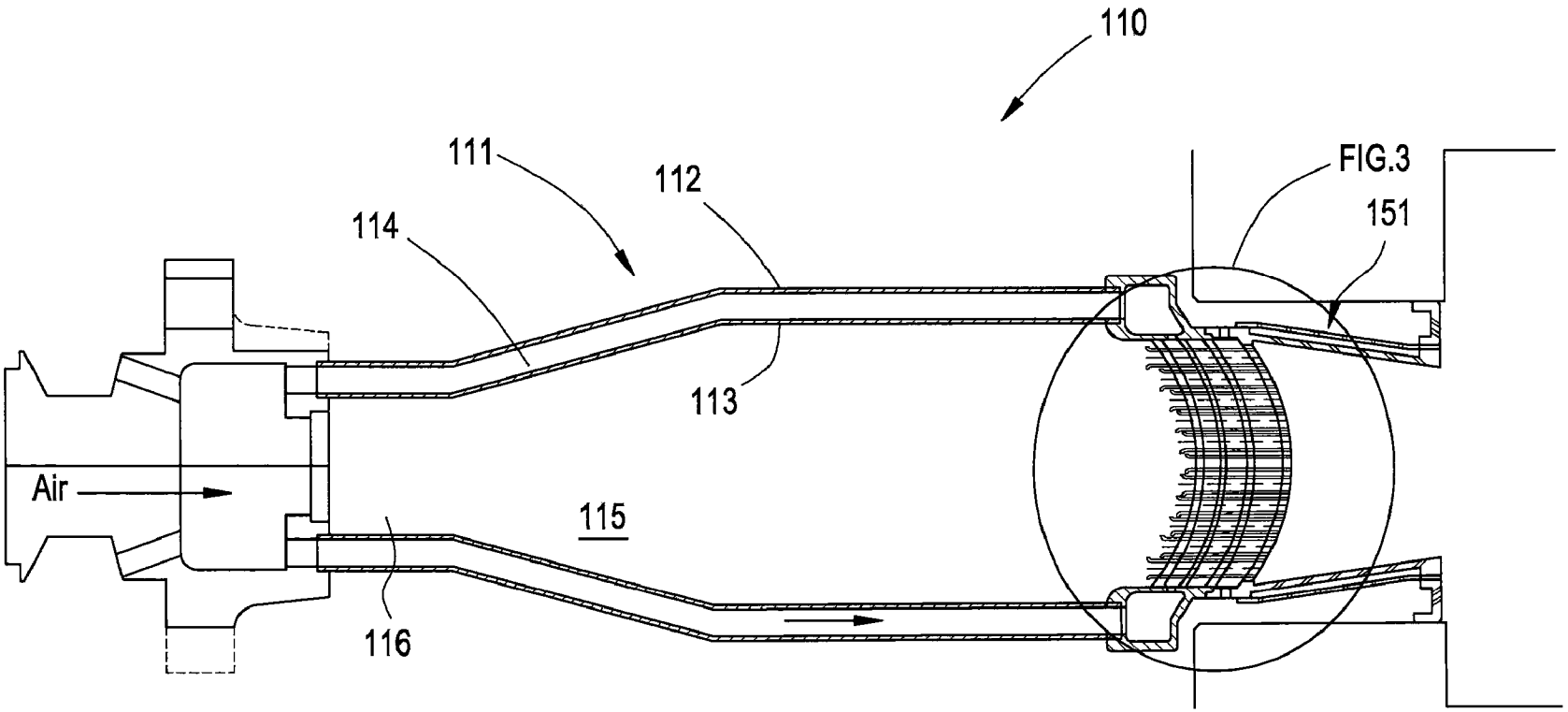
FIG. 2 is a cross-section of an injection nozzle in accordance with the present invention.

Referring now to FIG. 2, a cross-section through fuel injection nozzle 110 is shown. Nozzle 110 includes a main body portion 111 having an outer peripheral wall 112 and an inner peripheral wall 113 defining a fuel flow passage 114 disposed therebetween. An interior space 115 within inner peripheral wall 113 receives a supply of air from compressor 11 through the inlet end 116 of nozzle 110.

Figure 3:
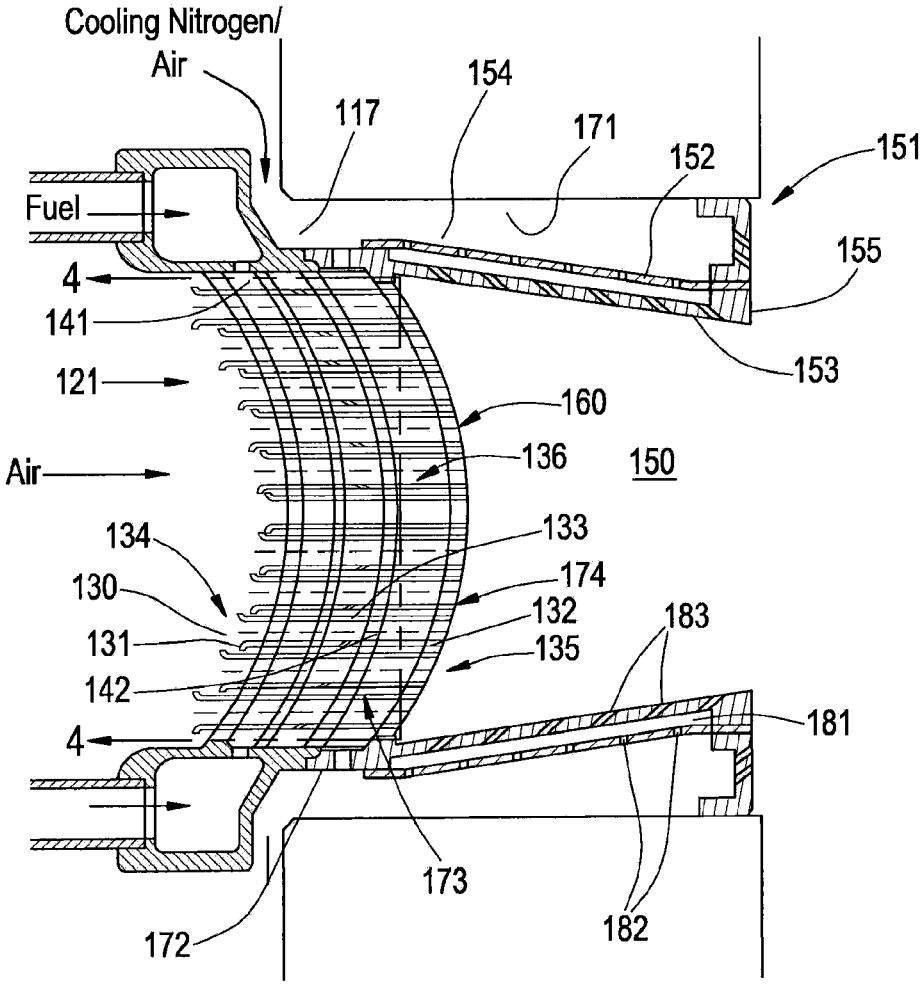
FIG. 3 is a detailed view of the area "FIG. 3" of FIG. 2.
Figure 4:
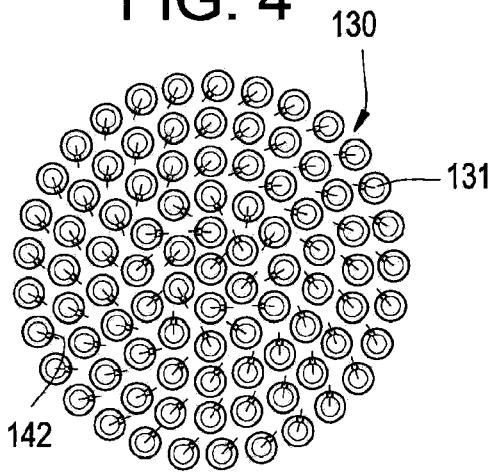
FIG. 4 is a cross-sectional view taken along line 4-4, of FIG. 3.

Referring now to FIGS. 3 and 4, showing additional details of nozzle 110, a plurality of fuel injection tubes is shown as a bundle of tubes 121 and adjacent an outlet end 117 of the main body portion 111. Bundle of tubes 121 is comprised of individual fuel/air mixing tubes (or injection tubes) 130 attached to each other and held in a bundle by end cap 136 or other conventional attachments. Each individual fuel/air mixing tube 130 includes a first end section 131 that extends to a second end section 132 through an intermediate portion 133. First end section 133 defines a first fluid inlet 134, while second end section 132 defines a fluid outlet 135.

Fuel flow passage 114 is fluidly connected to fuel plenum 141 that, in turn, is fluidly connected to a fluid inlet 142 provided in the each of the plurality of individual fuel/air mixing tubes 130. With this arrangement, air flows into first fluid inlet 134, of tubes 130, while fuel is passed through fuel flow passage 114, and enters plenum 141. Fuel flows around the plurality of fuel injection tubes 130 and passes through individual fluid inlets 142 to mix with the air within tubes 131 to form a fuel/air mixture. The fuel/air mixture passes from outlet 135 into an acceleration zone or mixing zone 150 and is ignited exterior thereof, to form a high temperature, high pressure gas flame that is delivered to turbine 30.

An acceleration zone or mixing zone 150 is defined by a second body portion 151, having an outer peripheral wall 152 and an inner peripheral wall 153, walls 152 and 153 extending between a first end 154 and a second end 155. First end 154 is connected to main body portion 111 adjacent the fluid outlet 135 of bundle of tubes 130. As best seen in FIG. 3, second body portion is converging between first end 154 and second end 155, creating acceleration zone 150 downstream of tube bundle 130. This causes continuous mixing of fuel and air after exiting fluid outlet 135 and has the effect of accelerating the fuel/air mixture to a flame zone exterior of acceleration zone 150 and second end 155. Tube bundle 130 forms a face 160 that is in the form of a spherically shade dome along the second end sections 132 of individual tubes 131. The dome shape is contemplated to prevent a sudden area expansion at fluid outlets 135 so that the tubes 131, along the periphery of inner peripheral wall 153, dump into acceleration zone 150.

In full load operations for low NOx, the flame should reside downstream past acceleration zone 150. Occasionally, flashback of the flame, into acceleration zone 150 will occur. If flashback or another flame inducing event occurs, flame may be held in acceleration zone 150 and cause damage to second body portion 151, and even tube bundle 130. Accordingly, a coolant is introduced along at least a portion of outer peripheral wall 152 of second body portion 151.

Coolant is introduced into a coolant plenum 171 adjacent tube bundle 130 and outer peripheral wall 152 of second body portion 151. Coolant flows through orifices 172 and around tube bundle 130 in a tube cooling passage 173. Thereafter, coolant is allowed to bleed from the face 160, from a plurality of bleed holes 174 of tube bundle 130, into acceleration zone 150. The coolant also cools the tube bundle's exit surface 160 to prevent thermal damage.

Coolant from plenum 171 is also introduced into a wall cooling passage 181 in a gap between the outer peripheral wall 152 and inner peripheral wall 153 of second body portion 151. Coolant enters cooling passage 181 through a plurality of inlet orifices 182 along outer peripheral wall 152. As shown, cooling inlet orifices 182 are generally orthogonal to outer peripheral wall 152 to provide an impinging cooling effect against inner peripheral wall 153. Cooling passage 181 also includes cooling outlet orifices 183 located along an inner peripheral wall 153. As shown, inner peripheral wall 153 and outer peripheral wall 154 are concentrically spaced, though any spacing to enhance coolant flow is acceptable. As cooling fluid flows from cooling outlet orifices 183, the inner surface of inner peripheral wall 153 is film cooled. As shown, the combination of film cooling, impinging cooling and convection cooling along the exterior surface of outer peripheral wall 152 and within cooling passage 181 provides resistance to thermal damage in the event of a flame flashback or a flame holding event within the nozzle 110. It will be appreciated that any one of these types of cooling may be sufficient to prevent damage due to flashback or flame holding.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. An injection nozzle comprising:

a main body portion having an outer peripheral wall;

a plurality of fuel/air mixing tubes disposed within said main body portion;

a fuel flow passage fluidly connected to said plurality of fuel/air mixing tubes;

a second body portion having an outer peripheral wall extending between a first end and an opposite second end, said first end connected to said main body portion adjacent the plurality of fuel/air mixing tubes, said second body portion converging from said first end toward said second end; and a first cooling passage at said second body portion and extending at least partially along said outer peripheral wall.

2. The injection nozzle of claim 1, including a second cooling passage located adjacent said plurality of fuel/air mixing tubes.

3. The injection nozzle of claim 1, wherein said plurality of mixing tubes are attached together adjacent a fluid outlet of each of said plurality of mixing tubes to form a single tube bundle.

4. The injection nozzle of claim 1, wherein said cooling passage includes a plurality of inlet orifices along the outer peripheral wall of said second body portion.

5. The injection nozzle of claim 4, wherein said cooling inlet orifices are generally orthogonal to the outer peripheral wall.

6. The injection nozzle of claim 4, wherein said first cooling passage is defined in a gap between said outer peripheral wall and an inner peripheral wall of said second body portion.

7. The injection nozzle of claim 6, wherein said cooling passage includes cooling outlet orifices located along said inner peripheral wall of said second body portion.

8. The injection nozzle of claim 1, wherein said first cooling passage is defined in a gap between said outer peripheral wall and an inner peripheral wall of said second body portion.

9. The injection nozzle of claim 8, wherein said inner peripheral wall and said outer peripheral wall are generally concentrically spaced apart.

10. The injection nozzle of claim 8, wherein said cooling passage includes cooling outlet orifices located along said inner peripheral wall of said second body portion.

11. A method of cooling an injection nozzle comprising:

guiding a first fluid into a plurality of mixing tubes disposed within a main body portion of said nozzle;

flowing a second fluid into said plurality of mixing tubes;

mixing said first and second fluids in said plurality of mixing tubes;

accelerating said first and second mixed fluids into a second body portion of said nozzle comprising a second mixing zone;

delivering said first and second fluids beyond an outer wall of said second body portion to a burn zone; and passing a coolant along at least a portion of said outer wall of said second body portion, and including passing a coolant along a portion of said plurality of mixing tubes.

12. The method of claim 11, including directing said coolant into said second mixing zone.

13. A method of cooling an injection nozzle comprising:

guiding a first fluid into a plurality of mixing tubes disposed within a main body portion of said nozzle;

flowing a second fluid into said plurality of mixing tubes;

mixing said first and second fluids in said plurality of mixing tubes;

accelerating said first and second mixed fluids into a second body portion of said nozzle comprising a second mixing zone;

delivering said first and second fluids beyond an outer wall of said second body portion to a burn zone; and passing a coolant along at least a portion of said outer wall of said second body portion, including directing said coolant into a cooling passage defined in a gap between said outer wall and an inner wall of said second mixing zone.

14. The method of claim 13, including directing said coolant through said inner wall and into said second mixing zone.

15. A method of cooling an injection nozzle comprising:

guiding a first fluid into a plurality of mixing tubes disposed within a main body portion of said nozzle;

flowing a second fluid into said plurality of mixing tubes;

mixing said first and second fluids in said plurality of mixing tubes;

accelerating said first and second mixed fluids into a second body portion of said nozzle comprising a second mixing zone;

delivering said first and second fluids beyond an end wall of said second body portion to a burn zone;

impinging at least a first coolant along at least a portion of a surface opposite an inner peripheral wall of said second body portion; and expelling said at least first coolant into said second mixing zone to create a film cooling zone along at least a portion of said inner peripheral wall of said second body portion.

16. The method of claim 15, including passing said at least first coolant along a portion of said plurality of mixing tubes.

17. The method of claim 15, including flowing said at least first coolant along an exterior surface of said second body portion for convection cooling.

18. The method of claim 15, wherein said coolant comprises an inert gas.

19. The method of claim 18, wherein said coolant comprises nitrogen.

20. The method of claim 15, wherein said coolant comprises air.

* * * * *